US006107203A

United States Patent [19]

Vanell

[11] Patent Number: 6,107,203

[45] Date of Patent: Aug. 22, 2000

[54] CHEMICAL MECHANICAL POLISHING SYSTEM AND METHOD THEREFOR

[75] Inventor: James F. Vanell, Tempe, Ariz.

[73] Assignee: Motorola, Inc., Schaumburg, Ill.

[21] Appl. No.: 08/963,486

[22] Filed: Nov. 3, 1997

[51] Int. Cl.[7] ..... H01L 21/302

[52] U.S. Cl. ..... 438/692; 438/693

[58] Field of Search ..... 438/690, 691, 438/692, 693

[56] References Cited

U.S. PATENT DOCUMENTS

| | | | |
|---|---|---|---|
| 5,222,867 | 6/1993 | Walker, Sr. et al. | 417/12 |
| 5,400,855 | 3/1995 | Stepp et al. | 166/151 |
| 5,477,844 | 12/1995 | Meister | 125/14 |
| 5,545,076 | 8/1996 | Yun et al. | 451/287 |
| 5,618,447 | 4/1997 | Sandhu | 438/14 |
| 5,738,574 | 4/1998 | Tolles et al. | 451/288 |

*Primary Examiner*—Benjamin L. Utech
*Assistant Examiner*—Kin-Chan Chen
*Attorney, Agent, or Firm*—A. Kate Huffman

[57] ABSTRACT

A chemical mechanical planarization tool (21) comprises a platen (22), a wafer carrier arm (31), a carrier assembly (37), a conditioning arm (28), and an end effector (33). A slurry delivery system (51) reduces waste by providing polishing chemistry at a minimum required delivery rate that ensures consistent wafer planarization. The slurry deliver system comprises a check valve (52), a diaphragm pump (53), a check valve (54), a back pressure valve (55), and a dispense bar (58). The diaphragm pump (53) provides a precise volume of polishing chemistry with each pump cycle, independent of input pressure. The check valves (52,54) prevent reverse flow of the polishing chemistry through the diaphragm pump (53). Back pressure valve (55) creates a pressure differential across the check valve (54) to prevent the flow of polishing chemistry during a downstroke of the diaphragm pump (53). The polishing chemistry is dispensed onto a polishing media from dispense bar (58).

12 Claims, 3 Drawing Sheets

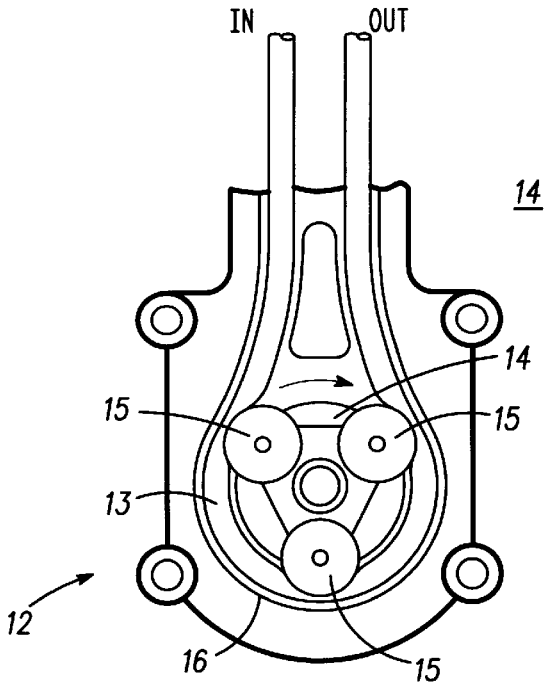
FIG. 1
FIG. 2
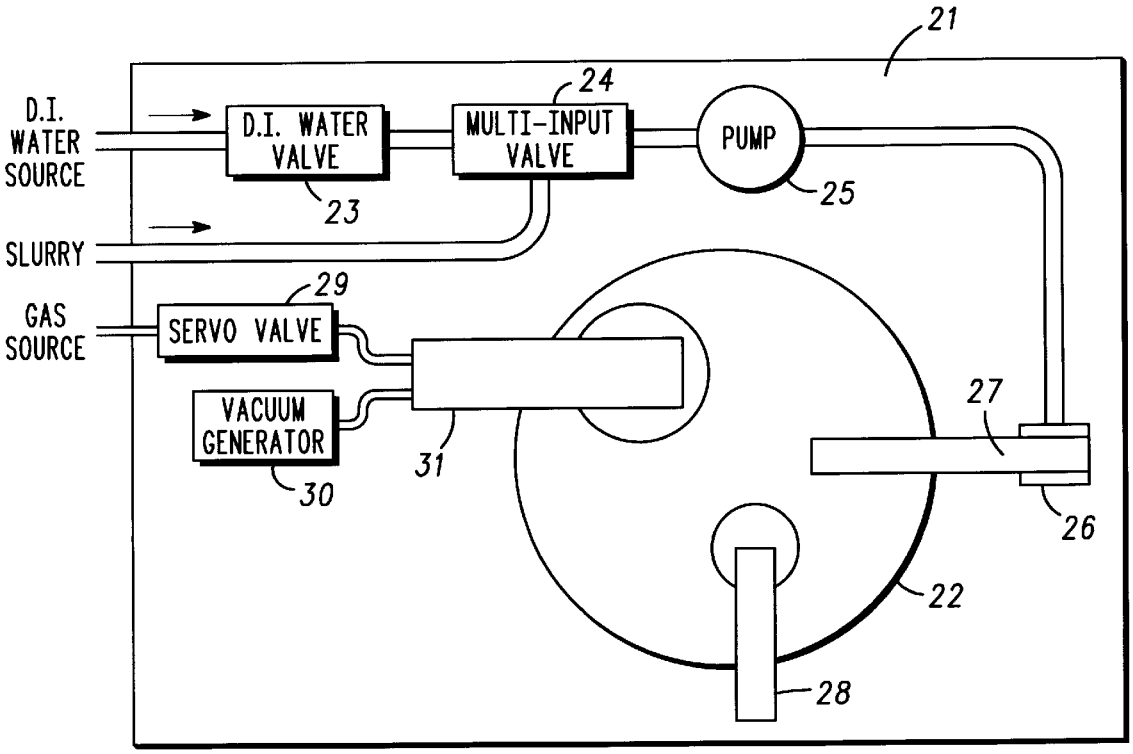

CHEMICAL MECHANICAL POLISHING SYSTEM AND METHOD THEREFOR

BACKGROUND OF THE INVENTION

The present invention relates, in general, to chemical mechanical planarization (CMP) systems, and more particularly, to pumps used in CMP systems.

Chemical mechanical planarization (also referred to as chemical mechanical polishing) is a proven process in the manufacture of advanced integrated circuits. CMP is used in almost all stages of semiconductor device fabrication. Chemical mechanical planarization allows the creation of finer structures via local planarization and for global wafer planarization to produce high density vias and interconnect layers. Materials that undergo CMP in an integrated circuit manufacturing process include single and polycrystalline silicon, oxides, nitrides, polyimides, aluminum, tungsten, and copper.

At this time, the expense of chemical mechanical planarization is justified for components such as microprocessors, ASICs (application specific integrated circuits), and other semi-custom integrated circuits that have a high average selling price. The main area of use is in the formation of high density multi-layer interconnects required in these types of integrated circuits. Commodity devices such as memories use little or no CMP because of cost.

The successful implementation of chemical mechanical planarization processes for high volume integrated circuit designs illustrates that major semiconductor manufacturers are embracing this technology. Semiconductor manufacturers are driving the evolution of CMP in several areas. A first area is cost, as mentioned hereinabove, CMP processes are not used in the manufacture of commodity integrated circuits where any increase in the cost of manufacture could impact profitability. Much of the research in CMP is in the area of lowering the cost per wafer of a CMP process. Significant progress in the cost reduction of CMP would increase its viability for the manufacture of lower profit margin integrated circuits. A second area is a reduction in the size or footprint of CMP equipment. A smaller footprint contributes to a reduced cost of ownership. Current designs for chemical mechanical planarization tools take up a significant amount of floor space in semiconductor process facility.

A third area being emphasized is manufacturing throughput and reliability. CMP tool manufacturers are focused on developing machines that can planarize more wafers in less time. Increased throughput is only significant if the CMP tool reliability also increases. A fourth area of study is the removal mechanism of semiconductor materials. Semiconductor companies are somewhat reliant on a limited number of chemical suppliers for the slurries or polishing chemistries used in different removal processes. Some of the slurries were not developed for the semiconductor industry but came from other areas such as the glass polishing industry. Research will inevitably lead the industry to high performance slurries that are tailored for specific semiconductor wafer processes. Advances in slurry composition directly impact removal rate, particle counts, selectivity, and particle aggregate size. A final area of research is post CMP processes. For example, post CMP cleaning, integration, and metrology are areas where tool manufacturers are beginning to provide specific tools for a CMP process.

Accordingly, it would be advantageous to have a chemical mechanical planarization tool that has improved reliability in a manufacturing environment. It would be of further advantage for the chemical mechanical planarization tool to reduce the cost of polishing each wafer.

BRIEF DESCRIPTION OF THE DRAWING

FIG. 1 is a cross-sectional illustration of a peristaltic pump used to delivery slurry in a chemical mechanical planarization tool;

FIG. 2 is a top view of a chemical mechanical planarization (CMP) tool in accordance with the present invention;

DETAILED DESCRIPTION OF THE DRAWING

Figure 3:
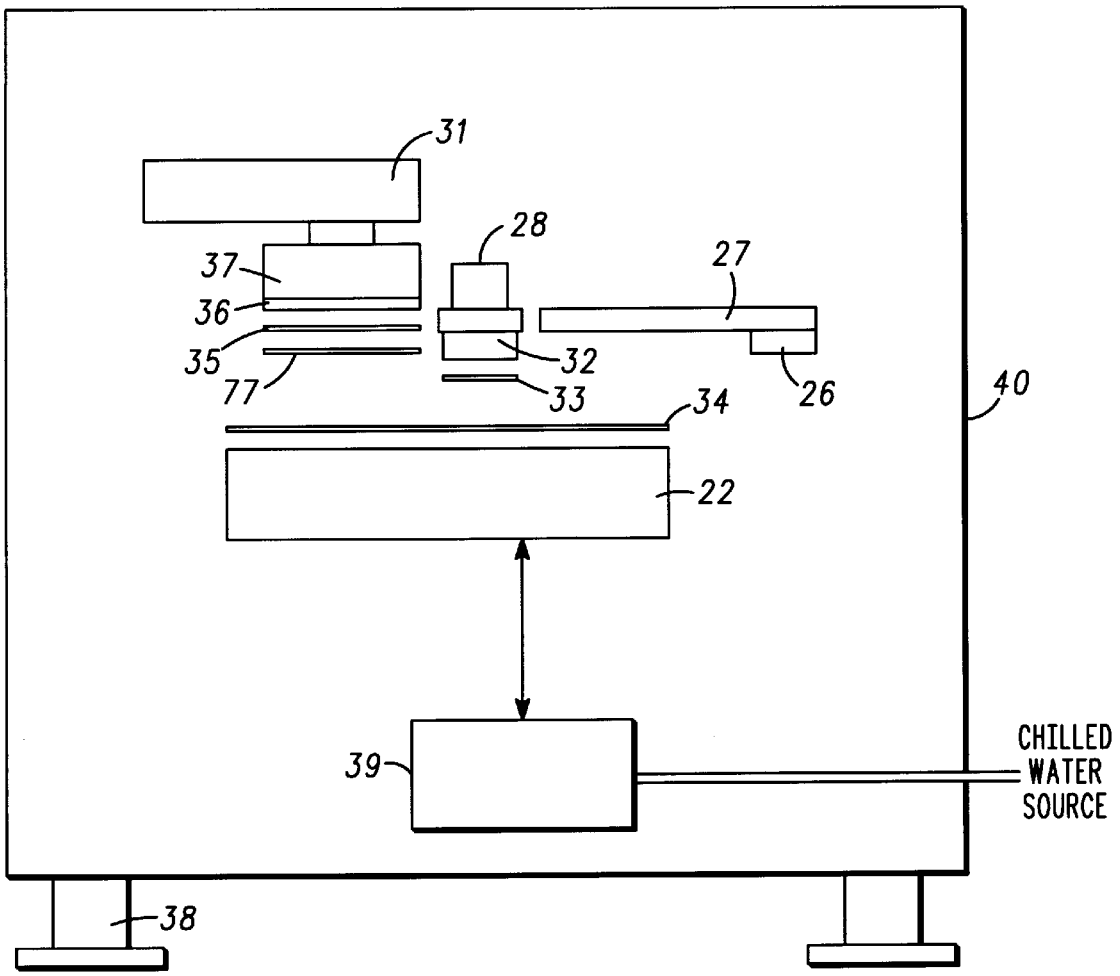
FIG. 3 is a side view of the chemical mechanical planarization (CMP) tool of FIG. 2 in accordance with the present invention.

A main component used in a chemical mechanical planarization (CMP) process is the polishing slurry. The slurry is a mixture of abrasives and chemicals, which mechanically and chemically remove material from a semiconductor wafer. The chemicals used in a slurry depend on the type of material being removed. Typically, the chemicals are either acidic or basic, which makes them strongly corrosive. The slurry is a consumable that is constantly replenished during a process as wafers are polished. This makes it a major consumable cost factor in a CMP process.

Other examples of consumables in a CMP process are deionized water and polishing pads. Polishing pads, which typically comprise polyurethane or some other polishing media are probably the second highest cost consumable in a CMP process. The cost of a pad per wafer typically is on the order of 25 percent of the cost per wafer of the polishing chemistry. Other consumables cost less than 5 percent of the cost of polishing slurry per wafer. Clearly, the largest gain in reducing the cost of chemical mechanical planarization per wafer can be found in the cost of the polishing slurry.

A slurry delivery system is a component of a chemical mechanical planarization tool. The slurry delivery system provides the polishing chemistry to the semiconductor wafer for polishing. Current CMP tools use peristaltic pumps to deliver the polishing chemistry to the semiconductor wafer. CMP tool manufacturers use peristaltic pumps because they allow the medium being delivered to be isolated from any pump components. This protects the critical pump components from the abrasives and corrosive polishing chemistry.

FIG. 1 is a cross-sectional illustration of a peristaltic pump 12 used to deliver slurry in a chemical mechanical planarization tool. The isolating mechanism of a peristaltic pump is a flexible tube 13. Ideally, the flexible tubing is impervious to the chemicals in the slurry. For example, flexible tube 13 is commonly made of silicone or norprene-type compounds. The polishing chemistry is delivered through flexible tube 13. The slurry never comes in contact with any component of peristaltic pump 12 by confining the slurry within flexible tube 13. One end of flexible tube 13 is coupled to an input (IN) for receiving slurry while the other end of flexible tube 13 is coupled to an output (OUT) of peristaltic pump 12.

A rotor 14 spins within a housing 16 of peristaltic pump 12. Rotor 14 is coupled to a motor (not shown). Attached to rotor 14 are rollers 15 for progressively compressing flexible tube 13. A minimum of two rollers are used in a peristaltic pump while some pump designs have many more rollers. The slurry is pushed or squeezed through flexible tube 13 as the rollers rotate within housing 16. An advantage of a peristaltic pump is freedom from internal leakage. Leakage only occurs if the tube ruptures. The amount of material that is delivered by peristaltic pump 12 is determined by the tube internal diameter, durometer, wall thickness, and delivery pressure. The rate of output delivery is changed by varying pump speed.

In general, peristaltic pump 12 is simple, cost efficient, and easy to maintain. However, peristaltic pump 12 does have problems when placed in a chemical mechanical planarization tool for delivering slurry. Typically, the slurry used to remove material from a semiconductor wafer cannot be allowed to sit or dry in the delivery system without dire consequences, which include hardening, agglomeration, and settling. The slurry, if allowed to sit or dry, subsequently clogs the delivery system, which results in a system that does not perform correctly, or damages a wafer.

To avoid the above mentioned problems, most slurry delivery system recirculate the slurry where possible. In addition, the system is flushed with water where recirculation of the polishing chemistry is not possible. Flushing with water often causes flexible tube 13 to rupture due to high water delivery pressures. The problem occurs because rollers 15 pinch flexible tube 13 against the housing 16 which prevents water flow. Water pressure at the input of peristaltic pump 12 inflates flexible tube 13 with water causing it to rupture.

As mentioned previously, the highest consumable cost in a chemical mechanical planarization process is the polishing chemistry. In theory, a minimum required amount of slurry is delivered by a chemical mechanical planarization tool, which uniformly removes a predetermined amount of material from a semiconductor wafer surface. Providing less than the minimum required amount of polishing chemistry produces non-uniform planarization, or worse, a damaged wafer. Providing more than the minimum required amount of polishing chemistry wastes slurry thereby increasing manufacturing costs. Semiconductor manufacturers typically provide too much slurry because the long term cost of polishing chemistry is less than the cost of damaged semiconductor wafers.

In a manufacturing environment the amount of slurry delivered is negatively impacted by the variability of peristaltic pump 12 over time. The variability in delivery of peristaltic pump 12 is determined by the service interval of flexible tube 13. The service interval is determined by an acceptable time period that prevents flexible tube 13 from splitting which produces a catastrophic failure that shuts down the CMP tool. Typically, service for peristaltic pump 12 for replacement of flexible tube 13 is on the order of once a month.

Another issue that is taken into account in determining the delivery rate of slurry is the input pressure. The input pressure (from a global slurry delivery system) of the polishing chemistry brought to peristaltic pump 12 varies significantly, for example, a range of 1406.2 to 7031.0 kilograms per square meter (2 to 10 pounds per square inch) of pressure would not be uncommon. In general, global slurry delivery systems are capable of providing slurry pressures in excess of what flexible tube 13 can withstand. Peristaltic pumps are sensitive to the input pressure of slurry. In fact, the delivery rate increases with higher input pressures because flexible tube 13 expands, carrying a larger volume, as the pressure increases. The onboard slurry delivery system of a CMP tool is set up to delivery greater than the minimum required amount of slurry at the lowest input pressure. Thus, a significant amount of slurry is wasted when the slurry input pressure is higher than the minimum pressure.

The delivery rate is also affected by plastic deformation of flexible tube 13. The rollers continuously squeeze or milk flexible tube 13 to deliver the polishing chemistry. Initially, flexible tube 13 rebounds to its original shape after being flattened by rollers 15. Progressively, plastic deformation occurs and flexible tube 13 does not rebound as much thereby changing the volume being delivered. In other words, flexible tube 13 takes a set or deforms over time. The slurry delivery rate also impacts plastic deformation. Increasing the slurry delivery rate (by increasing the speed of peristaltic pump 12) accelerates the rate of plastic deformation of flexible tube 13 over time. All the problems listed hereinabove tend to reduce the rate of slurry delivery over time.

Chemical mechanical planarization tool manufacturers currently do not offer any type of real time sensing of slurry flow. Semiconductor manufacturers do not want to chance going below the minimum required slurry flow so the slurry flow is compensated by a high initial delivery rate. The high initial delivery rate ensures that the minimum acceptable slurry flow is met until a time when flexible tube 13 is routinely changed for maintenance. The high initial delivery rate wastes slurry because the slurry delivery system provides more than is needed. It is estimated that the increased delivery rate of a typical chemical mechanical planarization system wastes approximately 25 percent or more slurry. Having an excess of more than 50 percent of the minimum required amount of polishing chemistry during the planarization process is not uncommon.

FIG. 2 is a top view of a chemical mechanical planarization (CMP) tool 21 in accordance with the present invention. CMP tool 21 comprises a platen 22, a deionized (DI) water valve 23, a multi-input valve 24, a pump 25, a dispense bar manifold 26, a dispense bar 27, a conditioning arm 28, a servo valve 29, a vacuum generator 30, and a wafer carrier arm 31.

Platen 22 supports various polishing media and chemicals used to planarize a processed side of a semiconductor wafer. Platen 22 is typically made of metal such as aluminum or stainless steel. A motor (not shown) couples to platen 22. Platen 22 is capable of rotary, orbital, or linear motion at user-selectable surface speeds.

Deionized water valve 23 has an input and an output. The input is coupled to a DI water source. Control circuitry (not shown) enables or disables DI water valve 23. DI water is provided to multi-input valve 24 when DI water valve 23 is enabled. Multi-input valve 24 allows different materials to be pumped to dispense bar 27. An example of the types of materials which are input to multi-input valve 24 are chemicals, slurry, and deionized water. In an embodiment of CMP tool 21, multi-input valve 24 has a first input coupled to the output of DI water valve 23, a second input coupled to a slurry source, and an output. Control circuitry (not shown) disables all the inputs of multi-input valve 24 or enables any combination of valves to produce a flow of selected material to the output of multi-input valve 24.

Pump 25 pumps material received from multi-input valve 24 to dispense bar manifold 26. The rate of pumping provided by pump 25 is user-selectable. Minimizing flow rate variation over time and differing conditions permits the flow to be adjusted near the minimum required flow rate, which reduces waste of chemicals, slurry, or DI water. Pump 25 has an input coupled to the output of multi-valve 24 and an output.

Dispense bar manifold 26 allows chemicals, slurry, or DI water to be routed to dispense bar 27. Dispense bar manifold 26 has an input coupled to the output of pump 25 and an output. An alternate approach utilizes a pump for each material being provided to dispense bar 27. For example, chemicals, slurry, and DI water each have a pump that couples to dispense bar manifold 26. The use of multiple pumps allows the different materials to be precisely mixed in different combinations by controlling the flow rate of each material by its corresponding pump. Dispense bar 27 distributes chemicals, slurry, or DI water onto a polishing media surface. Dispense bar 27 has at least one orifice for dispensing material onto the polishing media surface. Dispense bar 27 is suspended above and extends over platen 22 to ensure material is distributed over the majority of the surface of the polishing media.

Wafer carrier arm 31 suspends a semiconductor wafer over the polishing media surface. Wafer carrier arm 31 applies a user-selectable downforce onto the polishing media surface. In general, wafer carrier arm 31 is capable of rotary motion as well as a linear motion. A semiconductor wafer is held onto a wafer carrier by vacuum. Wafer carrier arm 31 has a first input and a second input.

Vacuum generator 30 is a vacuum source for wafer carrier arm 31. Vacuum generator 30 generates and controls vacuum used for wafer pickup by the wafer carrier. Vacuum generator 30 is not required if a vacuum source is available at the manufacturing facility. Vacuum generator 30 has a port coupled to the first input of wafer carrier arm 31. Servo valve 29 provides a gas to wafer carrier arm 31 for wafer ejection after planarization is complete. The gas is also used to put pressure on the backside of a wafer during planarization to control wafer profile. In an embodiment of CMP tool 21, the gas is nitrogen. Servo valve 29 has an input coupled to a nitrogen source and an output coupled to the second input of wafer carrier arm 31.

Conditioning arm 28 is used to apply an abrasive end effector onto a surface of the polishing media. The abrasive end effector planarizes the polishing media surface and cleans or roughens the surface to aid in chemical transport. Conditioning arm 28 typically is capable of both rotational and translational motion. The pressure or downforce in which the end effector presses onto the surface of the of the polishing media is controlled by conditioning arm 28.

FIG. 3 is a side view of the chemical mechanical planarization (CMP) tool 21 shown in FIG. 2. As shown in FIG. 3, conditioning arm 28 includes a pad conditioner coupling 32 and an end effector 33. CMP tool 21 further includes a polishing media 34, a carrier film 35, a carrier ring 36, a carrier assembly 37, machine mounts 38, heat exchanger 39, enclosure 40, and semiconductor wafer 77.

Polishing media 34 is placed on platen 22. Typically, polishing media 34 is attached to platen 22 using a pressure sensitive adhesive. Polishing media 34 provides a suitable surface upon which to introduce a polishing chemistry. Polishing media 34 provides for chemical transport and micro-compliance for both global and local wafer surface regularities. Typically, polishing media 34 is a polyurethane pad, is compliant and includes small perforations or annular groves throughout the exposed surface for chemical transport.

Carrier assembly 37 couples to wafer carrier arm 31. Carrier assembly 37 provides a foundation with which to rotate semiconductor wafer 77 in relation to platen 22. Carrier assembly 37 also puts a downward force on semiconductor wafer 77 to hold it against polishing media 34. A motor (not shown) allows user controlled rotation of carrier assembly 37. Carrier assembly 37 includes vacuum and gas pathways to hold semiconductor wafer 77 during planarization, profile semiconductor wafer 77, and eject semiconductor wafer 77 after planarization.

Carrier ring 36 couples to carrier assembly 37. Carrier ring 36 aligns semiconductor wafer 77 concentrically to carrier assembly 37 and physically constrains semiconductor wafer 77 from moving laterally. Carrier film 35 couples to a surface of carrier assembly 37. Carrier film 35 provides a surface for semiconductor wafer 77 with suitable frictional characteristics to prevent rotation due to slippage in relation to carrier assembly 37 during planarization. In addition, the carrier film is slightly compliant as an aid to the planarization process.

Pad conditioner coupling 32 couples to conditioning arm 28. Pad conditioner coupling 32 allows angular compliance between platen 22 and end effector 33. End effector 33 abrades polishing media 34 to achieve flatness and aid in chemical transport to the surface of semiconductor wafer 77 being planarized.

Chemical reactions are sensitive to temperature. It is well known that the rate of reaction typically increases with temperature. In chemical mechanical planarization, the temperature of the planarization process is held within a certain range to control the rate of reaction. The temperature is controlled by heat exchanger 39. Heat exchanger 39 is coupled to platen 22 for both heating and cooling. For example, when first starting a wafer lot for planarization the temperature is approximately room temperature. Heat exchanger 39 heats platen 22 such that the CMP process is above a predetermined minimum temperature to ensure a minimum chemical reaction rate occurs. Typically, heat exchanger 39 uses ethylene glycol as the temperature transport/control mechanism to heat or cool platen 22. Running successive wafers through a chemical mechanical planarization process produces heat, for example, carrier assembly 37 retains heat. Elevating the temperature at which the CMP process occurs increases the rate of chemical reaction. Cooling platen 22 via heat exchanger 39 ensures that the CMP process is below a predetermined maximum temperature such that a maximum reaction is not exceeded.

Machine mounts 38 raise chemical mechanical planarization tool 21 above floor level to allow floor mounted drip pans where they are not integral to the polishing tool. Machine mounts 38 also have an adjustable feature to level CMP tool 21 and are designed to absorb or isolate vibrations.

Chemical mechanical planarization tool 21 is housed in an enclosure 40. As stated previously, the CMP process uses corrosive materials harmful to humans and the environment. Enclosure 40 prevents the escape of particulates and chemical vapors. All moving elements of CMP tool 21 are housed within enclosure 40 to prevent injury.

Operation of chemical mechanical planarization tool 21 is described hereinbelow. No specific order of steps is meant or implied in the operating description as they are determined by a large extent to the type of semiconductor wafer polishing being implemented. Heat exchanger 39 heats platen 22 to a predetermined temperature to ensure chemicals in the slurry have a minimum reaction rate when starting a chemical mechanical planarization process. A motor drives platen 22 which puts polishing media 34 in one of rotational, orbital, or linear motion.

Wafer carrier arm 31 moves to pick up semiconductor wafer 77 located at a predetermined position. The vacuum generator is enabled to provide vacuum to carrier assembly 37. Carrier assembly 37 is aligned to semiconductor wafer 77 and moved such that a surface of carrier assembly contacts the unprocessed side of semiconductor wafer 77. Carrier film 35 is attached to the surface of carrier assembly 37. Both the vacuum and carrier film 35 hold semiconductor wafer 77 to the surface of carrier assembly 37. Carrier ring 36 constrains semiconductor wafer 77 centrally on the surface of carrier assembly 37.

Multi-input valve 24 is enabled to provide slurry to pump 25. Pump 25 provides the slurry to dispense bar manifold 26. The slurry flows through dispense bar manifold 26 to dispense bar 27 where it is delivered to the surface of polishing media 34. Periodically, deionized water valve 23 is opened to provide water through dispense bar 27 to displace the slurry to prevent it from hardening in dispense bar 27. The motion of platen 22 aids in distributing the polishing chemistry throughout the surface of polishing media 34. Typically, slurry is delivered at a constant rate throughout the polishing process.

Wafer carrier arm 31 then returns to a position over polishing media 34. Wafer carrier arm 31 places semiconductor wafer 77 in contact with polishing media 34. Polishing chemistry covers polishing media 34. Wafer carrier arm 31 puts downforce on semiconductor wafer 77 to promote friction between the slurry and semiconductor wafer 77. Polishing media 34 is designed for chemical transport which allows chemicals of the slurry to flow under semiconductor wafer 77 even though it is being pressed against the polishing media. As heat builds up in the system, heat exchanger 39 changes from heating platen 22 to cooling platen 22 to control the rate of chemical reaction.

It should be noted that it was previously stated that platen 22 is placed in motion in relation to semiconductor wafer 77 for mechanical polishing. Conversely, platen 22 could be in a fixed position and carrier assembly 37 could be placed in rotational, orbital, or translational motion. In general, both platen 22 and carrier assembly 37 are both in motion to aid in mechanical planarization.

Wafer carrier arm 31 lifts carrier assembly 37 from polishing media 34 after the chemical mechanical planarization process is completed. Wafer carrier arm 31 moves semiconductor wafer 77 to a predetermined area for cleaning. Wafer carrier arm 31 then moves semiconductor wafer 77 to a position for wafer unloading. Vacuum generator 30 is then disabled and servo valve 29 is opened providing gas to carrier assembly 37 to eject semiconductor wafer 77.

Uniformity of the chemical mechanical planarization process is maintained by periodically conditioning polishing media 34, which is typically referred to as pad conditioning. Pad conditioning promotes the removal of slurry and particulates that build up and become embedded in polishing media 34. Pad conditioning also planarizes the surface and roughens the nap of polishing media 34 to promote chemical transport. Pad conditioning is achieved by conditioning arm 28. Conditioning arm 28 moves end effector 33 into contact with polishing media 34. End effector 33 has a surface coated with industrial diamonds or some other abrasive which conditions polishing media 34. Pad conditioner coupling 32 is between conditioning arm 28 and end effector 33 to allow angular compliance between platen 22 and end effector 33. Conditioning arm 28 is capable of rotary and translational motion to aid in pad conditioning. Pad conditioning is done during a planarization process, between wafer starts, and to condition a new pad prior to wafer processing.

As mentioned previously, peristaltic pumps as used in the process for the delivery of polishing chemistry (slurry) in chemical mechanical planarization tools do not provide the polishing chemistry at a constant rate. The rate of delivery decreases with time. The peristaltic pumps are set to a high rate of delivery to compensate for the rate decrease over time to ensure that a sufficient amount of polishing chemistry is provided to the polishing media to planarize a semiconductor wafer without damage. The high rate of delivery provides more polishing chemistry than needed, typically greater than 25 percent of the polishing chemistry delivered is unneeded and wasted in the planarization process.

Empirical studies show that a minimum delivery rate of polishing chemistry can be defined for each type of planarization process. Providing less than the minimum delivery rate of polishing chemistry results in non-uniformity of the wafer planarization, a decrease in polish rate, or worse, wafer damage. Providing more than the minimum delivery rate wastes the polishing chemistry increasing manufacturing costs. Thus a pump that provides an accurate and constant delivery rate over time is desirable. One such pump is a positive displacement pump. A positive displacement pump displaces or pumps a fixed volume of material in each pumping cycle. For example, a peristaltic pump is not a positive displacement pump because the volume of material being delivered varies directly with input pressure and inversely with time. An example of a positive displacement pump is a diaphragm pump. The diaphragm pump delivers a fixed volume of material independent of input pressure changes.

Figure 4:
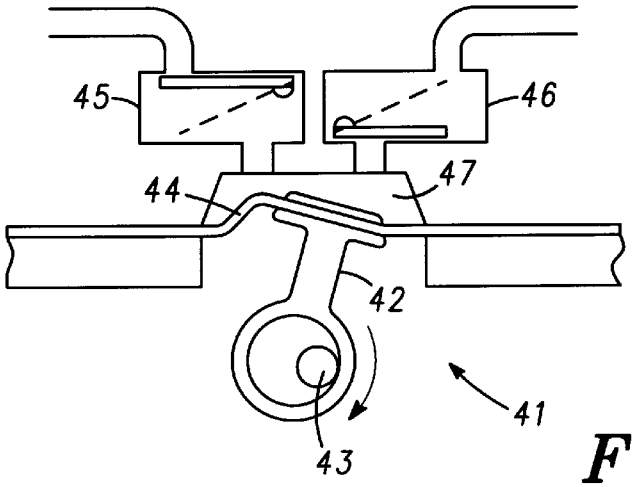
FIG. 4 is a cross-sectional illustration of a diaphragm pump for use in a chemical mechanical planarization tool in accordance with the present invention.

FIG. 4 is a cross-sectional illustration of a diaphragm pump 41 for use in a chemical mechanical planarization tool in accordance with the present invention. Diaphragm pump 41 isolates moving components from the corrosive chemistries of the slurry. Typically, all wetted surfaces of diaphragm pump 41 are a polymer composition inert to the polishing chemistry. Diaphragm pump comprises an input, an output, a plunger 42, a rotating member 43, a diaphragm 44, a check valve 45, a check valve 46, and a chamber 47.

Diaphragm 44 as shown is fitted to a surface of plunger 42. Diaphragm 44 isolates the polishing chemistry from moving components of diaphragm pump 41. An alternate approach has a plunger pressurizing a small volume of hydraulic fluid which in turn displaces a diaphragm. The advantage of using pressurized fluid is equalized pressure on the diaphragm. A motor (not shown) rotates rotating member 43. Rotating member 43 couples to plunger 42 where rotational motion is translated into reciprocating motion for moving plunger 42.

Check valve 45 allows polishing chemistry to enter into diaphragm pump 41. Chamber 47 varies in volume depending on the position of plunger 42. Chamber 47 has a maximum volume at the bottom of the stroke of plunger 42. Polishing chemistry provided at the input of diaphragm pump 41 is under pressure. The pressure opens check valve 45 allowing polishing chemistry to enter and fill chamber 47. Upward motion of plunger 42 overcomes the input pressure of the polishing chemistry closing check valve 45. Chamber 47 has a minimum volume when plunger 42 is at the top of the stroke. Plunger 42 pushes check valve 46 open and delivers a volume of polishing chemistry equal to the difference between the maximum and minimum volumes of chamber 47. Check valves 45 and 46 prevent backflow through diaphragm pump 41. In other words, polishing chemistry cannot flow in the opposite or reverse direction (output to input) through diaphragm pump 41.

Diaphragm 44 is not deformed to the extent where plastic deformation occurs. The excursions of plunger 42 are such that diaphragm 44 returns to its original shape after each pump cycle. Service requirements for diaphragm pump 41 are almost non-existent thereby substantially reducing downtime for a chemical mechanical planarization tool. In general, the service interval for diaphragm pump 41 is two years to replace the diaphragm and five years for the motor drive assembly.

Diaphragm pump 41 has a path from the input to the output that is independent of the position of plunger 42. The input pressure of the polishing chemistry delivers polishing chemistry into chamber 47 but also opens check valve 46. Polishing chemistry will flow out of the output of diaphragm pump 41 once chamber 47 is filled, wasting polishing chemistry. This problem is solved by holding check valve 46 closed during the downstroke of plunger 42 as chamber 47 fills.

Figure 5:
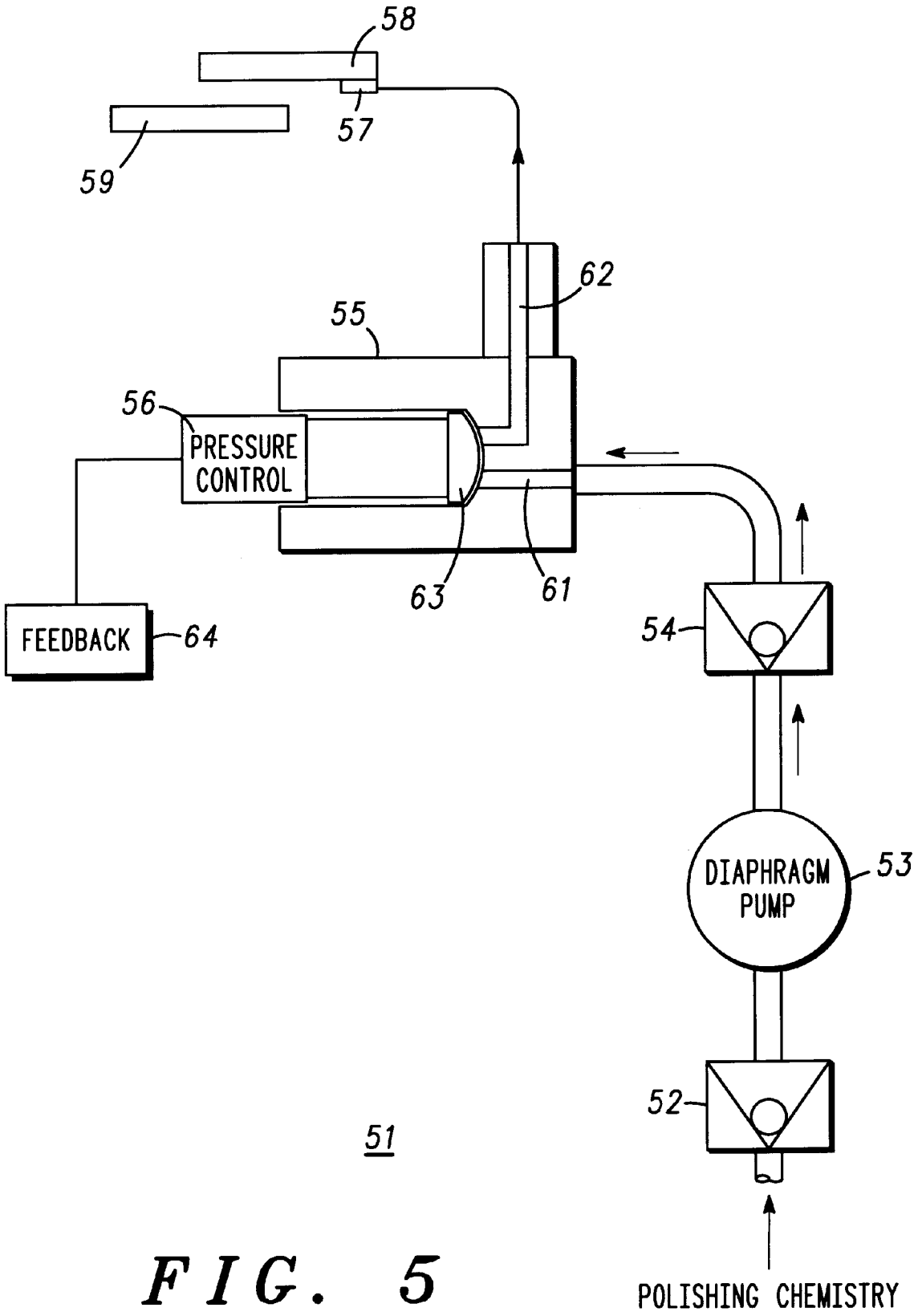
FIG. 5 is an illustration of a slurry delivery system for a chemical mechanical planarization tool in accordance with the present invention.

FIG. 5 is an illustration of a slurry delivery system 51 for a chemical mechanical planarization tool in accordance with the present invention. Slurry delivery system 51 comprises a check valve 52, a diaphragm pump 53, a check valve 54, a back pressure valve 55, a dispense bar manifold 57, a dispense bar 58, and a platen 59.

Check valve 52 includes an input for receiving polishing chemistry and an output. Polishing chemistry flows in the direction indicated by an arrow. Check valve 52 has a pathway that can be blocked to stop the flow of polishing chemistry. The pathway is blocked should the polishing chemistry attempt to flow in a reverse direction (backflow) to that indicated by the arrow. In other words, check valve 52 allows the polishing chemistry to flow in only one direction (into the pump).

Diaphragm pump 53 has an input coupled to the output of check valve 52 and an output for providing polishing chemistry. The input pressure of the polishing chemistry can vary significantly. Diaphragm pump 53 is a positive displacement pump thereby providing a consistent volume of polishing chemistry at the output with each pump cycle. Diaphragm pump 53 is capable of generating very high output pressures in driving the polishing chemistry downstream.

Check valve 54 includes an input coupled to the output of diaphragm pump 53 and an output. Polishing chemistry flows in the direction indicated by an arrow. Check valve 54 operates similarly to check valve 52 and includes a pathway that can be blocked to stop the flow of polishing chemistry. The pathway through diaphragm pump 53 is blocked by check valves 52 and 54 should the polishing chemistry attempt to flow in a direction opposite of that indicated by the arrow.

Back pressure valve 55 is employed in slurry delivery system 51 to eliminate the waste problem due to the polishing chemistry flowing through diaphragm pump 53 because of the pressure of the polishing chemistry at the input of check valve 52. The input pressure of the polishing chemistry opens check valve 52, fills a chamber of diaphragm pump 53, and opens check valve 54, flowing polishing chemistry out of the pump. Back pressure valve 55 creates a pressure differential across check valve 54 such that the pressure differential holds check valve 54 closed to prevent the unwanted flow of the polishing chemistry.

Back pressure valve 55 comprises an input, an output, a pathway 61, a valve 63, pressure control 56, and feedback control 64 (optional). The input of back pressure valve 55 couples to the output of check valve 54 and pathway 61. Pathway 61 is blocked by valve 63. Pathway 61 forms a contiguous channel from the input to the output of back pressure valve 55 when valve 63 is opened. A predetermined pressure is applied to valve 63 by pressure control 56 sealing or blocking pathway 61. Valve 63 is opened by providing polishing chemistry to the input of back pressure valve 55 having a pressure which exceeds the predetermined pressure. Feedback 64 allows for adjustment to the predetermined pressure.

The pressure differential across check valve 54 is generated by setting the predetermined pressure of pressure control 56 to a pressure greater than the maximum input pressure of the polishing chemistry at the input of check valve 52. For example, assume the input pressure of the polishing chemistry at the input of check valve 52 varies within a range of 1406.2 to 7031.0 kilograms per square meter (2 to 10 pounds per square inch). The maximum input pressure is 7031.0 kilograms per square meter. Setting pressure control 56 to provide a pressure of 10546.5 kilograms per square meter (15 pounds per square inch) on valve 63 ensures that check valve 54 is closed until diaphragm pump 53 is ready to deliver a precise volume of polishing chemistry. A minimum pressure differential of 3515.5 kilograms per square meter (5 pounds per square inch) holds check valve 54 closed during the down stroke of diaphragm pump 53. A maximum pressure differential of 9140.3 kilograms per square meter (13 pounds per square inch) occurs when the polishing chemistry pressure at the input of check valve 52 is 1406.2 kilograms per square meter (2 pounds per square inch). Diaphragm pump 53 is able to pump polishing chemistry at pressures exceeding 10546.5 kilograms per square meter (15 pounds per square inch).

A pumping cycle illustrates how waste is minimized in slurry delivery system 51. To start, assume diaphragm pump 53 is at the uppermost part of the stroke having delivered a metered amount of polishing chemistry. The plunger starts on a downstroke opening up the chamber of diaphragm pump 53. The pressure at the output of check valve 54 is greater than the pressure at the input of check valve 54 holding the valve closed. The input pressure of the polishing chemistry at the input of check valve 52 opens check valve 52 filling the chamber of diaphragm pump 53 until the plunger reaches the bottom of the downstroke (the chamber is filled to maximum volume). The upward stroke of the plunger generates pressure at the input of check valve 54. Polishing chemistries are made up of liquids and solid material and is therefore non-compressible. The pressure generated by diaphragm pump 53 exceeds the predetermined pressure applied on valve 63 by pressure control 56 which opens check valve 54 and valve 63. The plunger of diaphragm pump 53 displaces volume in the chamber delivering polishing chemistry at the output of back pressure valve 55. Note that with each pump cycle the plunger displaces a precise volume in the chamber, which is independent of the pressure at the input of check valve 52.

In an embodiment of back pressure valve 55, the predetermined pressure is mechanically generated to hold valve 63 closed. Typically, a spring provides the pressure holding valve 63 closed. The magnitude of the pressure is controlled by a screw mechanism which compresses or decompresses the spring to respectively increase and decrease the predetermined pressure. In general, a mechanically adjustable back pressure valve allows a single setting for the predetermined pressure which is adequate for most applications.

Feedback 64 allows adjustment to the predetermined pressure provided by pressure control 56 holding valve 63 closed. Changes in the polishing chemistry pressure at the input of check valve 52 are sensed and added or subtracted to the predetermined pressure holding valve 63 closed thereby providing a constant polishing chemistry pressure at the output of back pressure valve 55. Having an adjustment for the predetermined pressure allows the pressure differential across check valve 54 to be constant or regulated. Both pneumatic or electric feedback are used to compensate for changes in the polishing chemistry pressure at the input of check valve 52. Controlled pressurized gas is used to change the pressure holding valve 63 closed. Electrically created pressure changes are accomplished by motor or solenoid.

Most back pressure valves offered in the marketplace have a valve with a flat surface which seals against another flat surface in the pathway of the device. Use of this common type of back pressure valve produces pressure waves in the system that can destroy a diaphragm pump. For example, a pressure wave is sent towards the diaphragm pump when the back pressure valve shuts after delivering a volume of polishing chemistry. Pressure waves can also reflect back toward the diaphragm due to the valve "tea kettling" or chattering as the valve intermittently allows slurry to flow during a pump stroke. A worst case situation has the pressure wave hitting the diaphragm of the diaphragm pump with such force that the diaphragm ruptures, destroying the pump.

The pressure waves are significantly dampened or reduced in magnitude and frequency by using a back pressure valve that has a valve having a tapered surface for blocking a pathway within the back pressure valve. The sealing surface in the pathway may or may not have a taper corresponding to the tapered surface of the valve. For example, valve 63 is shown with an arced face. The Ryan Herco Company makes back pressure valves under the name PLAST-O-MATIC, some of which have a valve with an arced surface or face.

Dispense bar manifold 57 has an input coupled to the output of back pressure valve 55 and an output. Dispense bar 58 has an input coupled to the output of dispense bar manifold 57 and an output for providing polishing chemistry. Dispense bar 58 is suspended over a platen 59. A volume of polishing chemistry equal to the amount displaced by the plunger of diaphragm pump 53 flows through dispense bar manifold 57 and dispense bar 58 and is dispensed onto a surface of a polishing media on platen 59. Movement of platen 59 distributes the polishing chemistry over the surface. A semiconductor wafer is placed in contact with the polishing chemistry and polishing media. It should be noted that chemical mechanical planarization tools utilize several different types of motion to mechanically polish a semiconductor wafer. For example, rotational, orbital, and translational motion are used on a platen or wafer carrier to produce movement between the semiconductor wafer and the polishing media.

By now it should be appreciated that an apparatus and method for planarizing a semiconductor wafer has been provided. The CMP tool includes a platen that supports the semiconductor wafer during the planarization process. A polishing media on the platen provides a surface suitable for a polishing chemistry. A diaphragm pump pumps the polishing chemistry to a dispense bar. The diaphragm pump is a positive displacement pump that provides a constant volume of polishing chemistry with each pump cycle. The accuracy and reliability of the diaphragm pump allows the flow rate to be set near the required minimum to reduce waste of the polishing chemistry, the reliability of the pump extends the time to service significantly. The dispense bar is suspended over the platen and dispenses polishing chemistry onto the polishing media. The processed side of a semiconductor wafer is placed in contact with the polishing media to promote planarization. The platen, semiconductor wafer, or both are put into motion to planarize the semiconductor wafer.

A check valve is placed before and after the diaphragm pump. The check valves prevent polishing chemistry from flowing in a reverse direction from the pumping direction. A back pressure valve is placed downstream of the diaphragm pump output to create a pressure differential across the check valve at the output of the diaphragm pump. The back pressure valve (to flow polishing chemistry) is set to a pressure greater than a maximum pressure of the polishing chemistry at the input of the diaphragm pump (or the input of a checkvalve coupled to the input of the diaphragm pump). The back pressure valve prevents polishing chemistry from flowing through the diaphragm pump due to the pressure of the polishing chemistry at the input of the pump.

The back pressure valve includes a pathway to flow polishing chemistry. The back pressure valve has a valve with a tapered surface or face to prevent damaging pressure waves from being developed in the system when the valve closes. The valve is held closed by the pressure provided by the pressure control.

Further control of the downstream pressure is achieved by controlling the pressure to open the back pressure valve. The pressure to open the back pressure valve is increased/decreased if the pressure at the input of the diaphragm pump increases/decreases. In general, the pressure compensation produces a constant pressure differential across the check valve at the output of the diaphragm pump.

The use of the diaphragm pump, check valves, and the back pressure valve allows for the delivery of a constant and precise volume of polishing chemistry. The delivery rate is set at or near a required minimum flow rate to ensure consistent wafer planarization. Polishing chemistry is not wasted because the minimum required amount is used which provides substantial cost savings. Maintenance and reliability of the slurry delivery system is also improved which extends the time period to maintenance and increases wafer throughput.

What is claimed is:

1. A chemical mechanical planarization process for a semiconductor wafer comprising the steps of:

providing a polishing slurry to a positive displacement pump, said positive displacement pump having an input and an output;

preventing forward flow of said polishing slurry to a surface of a polishing media until pressure at said output of said positive displacement pump exceeds a first pressure;

pumping said polishing slurry with said positive displacement pump onto said surface of said polishing media after said pressure exceeds said first pressure;

placing a semiconductor wafer in contact with said surface of said polishing media; and moving at least one of said polishing media or the semiconductor wafer to remove material from the semiconductor wafer.

2. The method as recited in claim 1 further including the step of:

preventing reverse flow of said polishing slurry through said positive displacement pump.

3. The method as recited in claim 1 wherein said step of preventing forward flow of said polishing slurry includes preventing forward flow of said polishing slurry until said pressure at the output of the positive displacement pump exceeds a pressure between about 1406.2 kilograms per square meter and about 10,546.5 kilograms per square meter.

4. The method as recited in claim 1 wherein said step of preventing forward flow of said polishing slurry includes the steps of:

blocking a pathway for said polishing slurry downstream of said output of said positive displacement pump; and opening said pathway when said pressure at said output of said positive displacement pump exceeds said first pressure.

5. The method as recited in claim 4 wherein said blocking said pathway includes the steps of:

providing a sealing surface in said pathway; and providing a valve for blocking said pathway, said valve having a tapered surface, said valve being opened when pressure at said positive displacement pump exceeds said first pressure.

6. The method as recited in claim 5 further including a step of mechanically holding said valve closed.

7. The method as recited in claim 6 further including a step of regulating pressure downstream of said output of said positive displacement pump.

8. The method as recited in claim 7 wherein said step of regulating the pressure downstream of said output of said positive displacement pump includes a step of pneumatically adjusting said first pressure to compensate for changes in pressure at said input of said positive displacement pump.

9. The method as recited in claim 7 wherein said step of regulating the pressure downstream of said output of said positive displacement pump includes a step of electrically adjusting said first pressure on said valve to compensate for changes in pressure at said input of said positive displacement pump.

10. A method of chemical mechanical planarization comprising the steps of:

providing a polishing media;

providing a polishing slurry;

pumping said polishing slurry to said polishing media with a diaphragm pump;

blocking forward flow of said polishing slurry to said polishing media until pressure of said polishing slurry at an output of said diaphragm pump exceeds a first pressure;

distributing said polishing slurry to a surface of said polishing media, when said pressure exceeds said first pressure;

placing a semiconductor wafer in contact with said polishing media; and moving at least one of said polishing media or the semiconductor wafer.

11. The method as recited in claim 10 further including a step of preventing reverse flow of said polishing slurry through said diaphragm pump.

12. The method as recited at claim 11 further including a step of adjusting said first pressure to compensate for changes in pressure at said input of said diaphragm pump such that a pressure difference between said first pressure and an input pressure of said polishing slurry at said input of said diaphragm pump is constant.

* * * * *